US008631672B2

(12) United States Patent
Unger et al.

(10) Patent No.: US 8,631,672 B2
(45) Date of Patent: Jan. 21, 2014

(54) APPARATUS FOR CONTINUOUS CORRUGATION OF A METALLIC TUBE

(75) Inventors: Wilhelm Unger, Porta Westfalica (DE); Volker Zummach, Alfeld (DE); Claus Friedrich Theune, Pattensen (DE)

(73) Assignee: Nexans, Paris (FR)

( * ) Notice: Subject to any disclaimer, the term of this patent is extended or adjusted under 35 U.S.C. 154(b) by 544 days.

(21) Appl. No.: 12/956,078

(22) Filed: Nov. 30, 2010

(65) Prior Publication Data

US 2011/0132053 A1 Jun. 9, 2011

(30) Foreign Application Priority Data

Dec. 4, 2009 (EP) ..... 09306178

(51) Int. Cl.
*B21D 15/00* (2006.01)
*B21D 15/04* (2006.01)

(52) U.S. Cl.
USPC ..... 72/77; 72/112

(58) Field of Classification Search
USPC ..... 72/77, 112, 56, 59, 79, 121, 370.19, 78; 29/33 D; 228/173.7
See application file for complete search history.

(56) References Cited

U.S. PATENT DOCUMENTS

| | | | | |
|---|---|---|---|---|
| 4,486,176 | A * | 12/1984 | Tardieu et al. | 433/133 |
| 5,325,693 | A * | 7/1994 | Hoffmann et al. | 72/77 |
| 6,405,919 | B2 | 6/2002 | Frohne et al. | |
| 2001/0010113 | A1 | 8/2001 | Frohne et al. | |

* cited by examiner

*Primary Examiner* — Dana Ross
*Assistant Examiner* — Mohammad I Yusuf
(74) *Attorney, Agent, or Firm* — Sofer & Haroun, LLP

(57) ABSTRACT

An apparatus is specified for continuous corrugation of a metallic tube (1) which apparatus has a tool holder (13), which can rotate about the initially smooth tube and has a tool (14) which is mounted eccentrically with respect to the tube and forces a corrugation into the tube during operation of the apparatus, which corrugation runs transversely with respect to the longitudinal direction of the tube. A first hollow shaft (12) is attached to the tool holder (13), projects in the pulling-off direction from it, surrounds the tube after the corrugation process and can be rotated about its axis with the tool holder (13) by an electric motor. A second hollow shaft (16) is arranged at a distance from the first hollow shaft (12) and coaxially about the end, facing away from the tool holder (13), of the first hollow shaft (12), which second hollow shaft (16) is mounted such that it can rotate about its axis and can be driven by the electric motor. In order to transmit force between the first hollow shaft (12) and the second hollow shaft (16), a magnetic coupling is fitted, which consists of two annular permanent magnets, which are arranged concentrically with respect to one another and which are separated from one another by an air gap, and of which the first permanent magnet (15) is attached on the outside to the first hollow shaft (12) and the second permanent magnet (19) is attached on the inside to the second hollow shaft (16).

2 Claims, 2 Drawing Sheets

APPARATUS FOR CONTINUOUS CORRUGATION OF A METALLIC TUBE

RELATED APPLICATION

This application claims the benefit of priority from European Patent Application No. 09 306 178.6, filed on Dec. 4, 2009, the entirety of which is incorporated by reference.

BACKGROUND

1. Field of the Invention

The invention relates to an apparatus for continuous corrugation of a metallic tube, which apparatus has a tool holder, which can rotate about the initially smooth tube and has a tool which is mounted eccentrically with respect to the tube and forces a corrugation into the tube during operation of the apparatus, which corrugation runs transversely with respect to the longitudinal direction of the tube, and which tool has a withdrawal device for movement of the tube in its longitudinal direction, in which a first hollow shaft is attached to the tool holder, projects in the pulling-off direction from it, surrounds the tube after the corrugation process and can be rotated about its axis with the tool holder by an electric motor, and in which the unit comprising the tool holder and the first hollow shaft is mounted such that it can move in the axial direction (EP 1 084 774 B1).

2. Description of Related Art

Because of the corrugation, tubes such as these can on the one hand be bent well and on the other hand are robust in respect of forces acting on them in the radial direction. They can be used to transport fluid media, or else as casings or conductors for electrical and/or optical cables. A corresponding tube may be composed of steel as a casing which is used to protect a cable core. It is advantageously used as a conductor in radio-frequency cables. It is then advantageously composed of copper.

In the apparatus according to EP 1 084 774 B1, which was cited initially, the first hollow shaft, which is attached to the tool holder, at the same time forms the rotor of the driving electric motor, whose stator is fitted to fittings of the apparatus. During operation of the apparatus, the first hollow shaft is therefore rotated about its axis as part of the electric motor. In the process, it drives the tool holder, which is firmly connected to it and whose tool forces the corrugation into the tube, which is moved continuously through the tool holder, in its axial direction. The tool holder with the connected hollow shaft as well as the stator of the electric motor are combined in this known apparatus to form one unit, which is mounted such that it can move in the axial direction. This makes it possible to compensate for discrepancies in the corrugated means from a predetermined central position, which discrepancies can occur during continuous manufacture. The weight of the described unit is relatively high, as a result of which a relatively large amount of complexity is required for the capability to move it easily.

OBJECTS AND SUMMARY

The invention is based on the object of designing the apparatus mentioned initially to be simpler and lighter, with the aim of being able to achieve higher rotation speeds for the revolution of the tool holder.

According to the invention, this object is achieved:

in that a second hollow shaft is arranged at a distance from the first hollow shaft and coaxially about the end, facing away from the tool holder, of the first hollow shaft, which second hollow shaft is mounted such that it can rotate about its axis and can be driven by the electric motor, and in that, in order to transmit force between the first hollow shaft and the second hollow shaft, a magnetic coupling is fitted, which consists of two annular permanent magnets, which are arranged concentrically with respect to one another, a first permanent magnet and a second permanent magnet, which permanent magnets are separated from one another by an air gap, and of which the first permanent magnet is attached on the outside to the first hollow shaft and the second permanent magnet is attached on the inside to the second hollow shaft.

In this apparatus, the driving electric motor on the one hand, and the unit which is to be rotated about its axis and comprises the tool holder and connected first hollow shaft, on the other hand, are mechanically decoupled. In order to compensate for tolerances in the manufacturing process, only the tool holder and the first hollow shaft, which is connected to it, therefore need be arranged such that they can be moved axially. This not only results in a considerably reduced weight for the parts to be moved, but also in a simplified design for the apparatus. The driving electric motor may be mounted in the apparatus such that it is fixed and cannot move. Possible axial movements of the tool holder and first hollow shaft are compensated for without any reactions on the electric motor, by means of the magnetic coupling which is arranged between the first hollow shaft and the second hollow shaft. Since fewer parts have to be moved in total, and the bearing of the first hollow shaft is shifted together with it, it is possible to use bearings with a higher permissible rotation speed. This makes it possible to increase the rotation speed of the first hollow shaft, together with the tool holder.

BRIEF DESCRIPTION OF THE DRAWINGS

One exemplary embodiment of the subject matter of the invention is illustrated in the drawings, in which.

DETAILED DESCRIPTION

The following description is based on a smooth metallic tube for the corrugation process which, for example, may be composed of steel, copper or aluminium. It is of secondary importance how the tube has been produced. By way of example, it may be formed from a metal ribbon to form a slotted tube, whose slot running in the longitudinal direction is closed by welding, as is described, for example, in the initially cited EP 1 084 774 B1.

Figure 1:
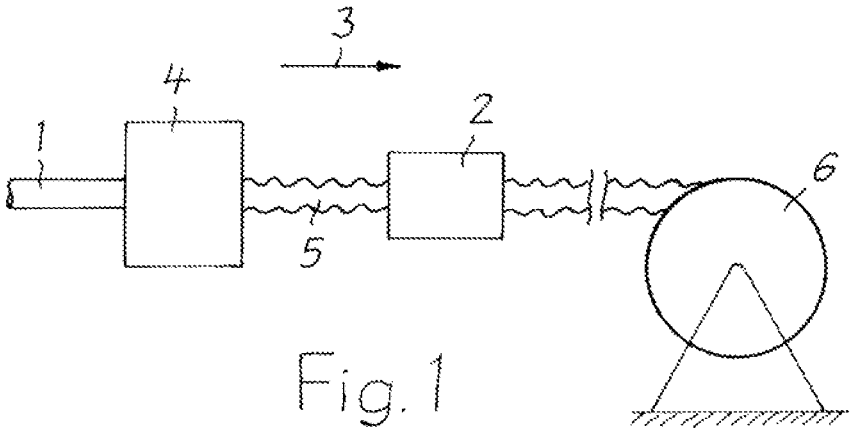
FIG. 1 shows a schematic illustration of an apparatus for corrugation of a metallic tube.

As shown in FIG. 1, a smooth tube 1 is moved in its longitudinal direction, in the direction of the arrow 3, by means of a withdrawal device 2 which is indicated only by a small box, and in the process is moved through an apparatus 4 in which a corrugation running transversely with respect to the longitudinal direction of the smooth tube 1 is forced into it. The corrugated tube 5 emerging from the apparatus 4 and being moved by the withdrawal device 2 can be wound onto a spool 6. Any known withdrawal device can be used as the withdrawal device 2, for example a caterpillar withdrawal device or a collet device, as is described in the initially cited EP 1 084 774 B1. The tube 5 may be corrugated in a helical shape or annular shape.

Figure 2:
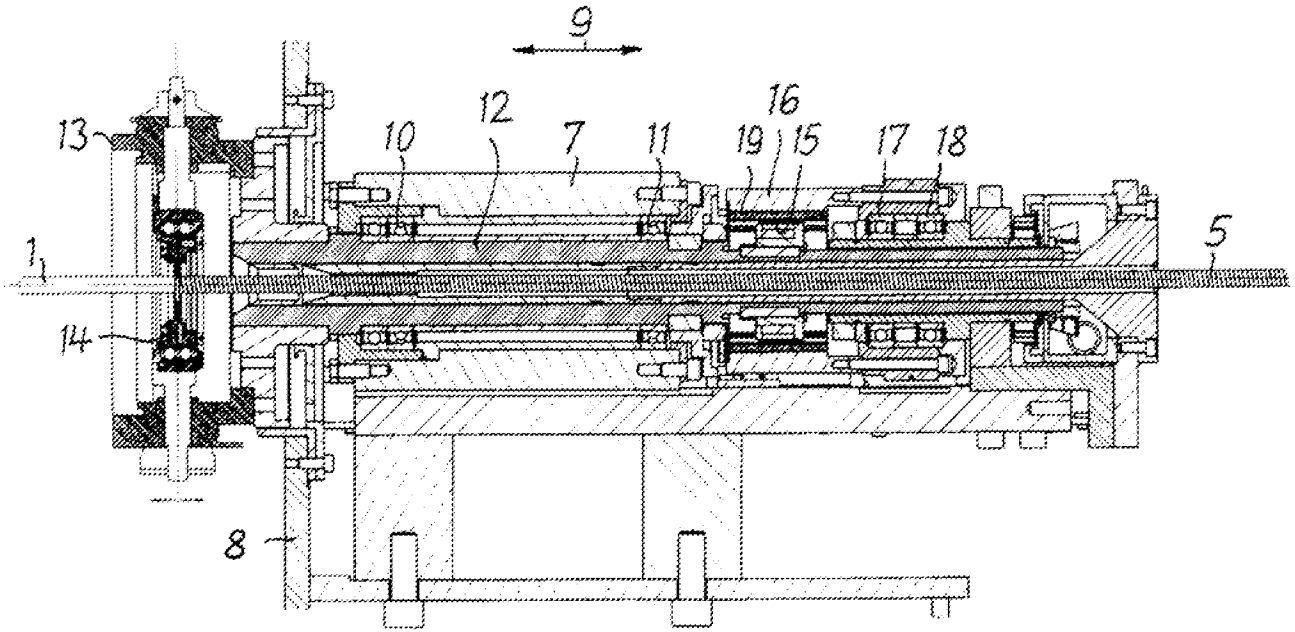
FIG. 2 shows the apparatus, as used in the apparatus shown in FIG. 1, for corrugation of the tube, illustrated enlarged.

The design of the apparatus 4 is illustrated enlarged, for example, in FIG. 2:

The apparatus 4 has a frame 7 which, for example, can be moved in the direction of the double-headed arrow 9 within a rack 8 by means of a cylindrical roller or linear guide, which is not also illustrated. Two bearing points 10 and 11 are fitted to the frame 7 and, for example, are in the form of roller bearings. A first hollow shaft 12 is mounted at the two bearing points 10 and 11 such that it can rotate about its axis.

The first hollow shaft 12 is firmly connected at one of its axial ends to a tool holder 13 which has a tool 14, which is mounted eccentrically with respect to the tube and forces a corrugation into the tube 1 during operation of the apparatus with the tube passing continuously through it. The corrugated tube 5 is produced behind the tool 14 in the pulling-off direction (arrow 3 in FIG. 1). Tolerances which may occur during the corrugation process are compensated for by the capability to move the frame 7 axially, together with which only the first hollow shaft 12 and the tool holder 13 are moved.

Figure 3:
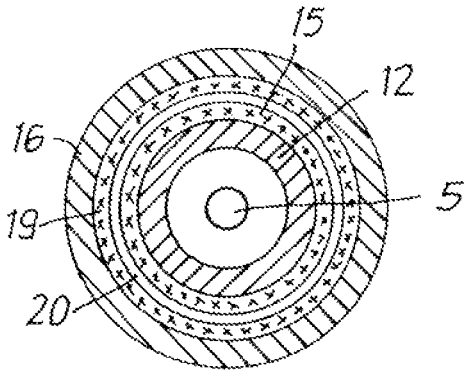
FIG. 3 shows a detail from FIG. 2, in the form of a section, and in the form of a further-enlarged illustration.

At the axial end of the first hollow shaft 12 facing away from the tool holder 13, a first annular permanent magnet 15, which surrounds said axial end, is fitted in a fixed position. A second hollow shaft 16 is arranged above this end of the first hollow shaft 12 and is mounted concentrically with respect to the first hollow shaft 12, such that it can rotate about its axis. For this purpose, two bearing points 17 and 18 are fitted to the rack 8 of the apparatus 4, and may once again be in the form of roller bearings. A second, annular permanent magnet 19 is mounted within the second hollow shaft 16 at the same height as the first permanent magnet 15, completely surrounds the first permanent magnet 15 and, in the installed position, is separated from it by an air gap 20. This can be seen in the enlarged illustration in FIG. 3, which schematically illustrates a section through the magnetic coupling formed by the permanent magnets 15 and 19. By way of example, the second hollow shaft 16 is connected to an electric motor, which is also not illustrated, by means of a pulley bar, and the electric motor is used to rotate the second hollow shaft 16 about its axis during operation of the apparatus 4.

The second hollow shaft 16, which rotates about its axis, drives the first hollow shaft 12 via the magnetic coupling formed by the two permanent magnets 15 and 19, which first hollow shaft 12 is rotated together with the tool holder 13, and at the same speed of revolution as the second hollow shaft 16, about its axis and therefore about the smooth tube 1. The electric motor which drives the two hollow shafts 12 and 16 is mechanically decoupled from the first hollow shaft 12, and therefore from the tool holder 13, by means of the magnetic coupling. The axial movements of the first hollow shaft 12, including the tool holder 13, which are possible, because the frame 7 is mounted such that it can move, are therefore not transmitted to the second hollow shaft 16 and the electric motor.

The two permanent magnets 15 and 19 advantageously have different widths in the axial direction in order that their position relative to one another is stable. Therefore, however, in practice they also do not build up any forces acting in the axial direction in the area which is only small but is required for movement of the first hollow shaft 12, as a result of which they do not impede the capability of the first hollow shaft 12 to move axially. In this sense, in the illustrated exemplary embodiment, the first permanent magnet 15 is shorter and/or narrower than the second permanent magnet 19 in the axial direction. However, the first permanent magnet 15 could also be designed to be broader than the second permanent magnet 19.

The invention claimed is:

1. Apparatus for continuous corrugation of a metallic tube, said apparatus comprising:

a tool holder, rotating about an initially smooth tube and having a tool mounted concentrically with respect to said tube and forcing a corrugation into said tube during operation of said apparatus, said corrugation runs transversely with respect to a longitudinal direction of said tube, and said tool has a withdrawal device for movement of said tube in said longitudinal direction, a first hollow shaft is attached to said tool holder and projects in the pulling-off direction from it, surrounds said tube after the corrugation process and is rotated about its axis with said tool holder by an electric motor, and a unit including said tool holder and said first hollow shaft is mounted such that it moves in the axial direction, a second hollow shaft is arranged at a distance from said first hollow shaft and coaxially about the end, facing away from said tool holder, of said first hollow shaft, said second hollow shaft is mounted such that it rotates about its axis and is driven by said electric motor, and wherein in order to transmit force between said first hollow shaft and said second hollow shaft, a magnetic coupling is fitted, having two annular permanent magnets, arranged concentrically with respect to one another, a first permanent magnet and a second permanent magnet, wherein said permanent magnets are separated from one another by an air gap, and of which the first permanent magnet is attached on the outside to said first hollow shaft and the second permanent magnet is attached on the inside to said second hollow shaft.

2. Apparatus according to claim 1, wherein the two permanent magnets have different widths in the axial direction.

* * * * *